US006262639B1

(12) United States Patent
Shu et al.

(10) Patent No.: US 6,262,639 B1
(45) Date of Patent: Jul. 17, 2001

(54) BANDPASS FILTER WITH DIELECTRIC RESONATORS

(75) Inventors: Tae Won Shu; Young Cheol Yoo; Chang Su Jang; Han Jong Ryu; Su Dug Seo, all of Kyunggi-do (KR)

(73) Assignee: ACE Technology, Kyunggi-do (KR)

( * ) Notice: Subject to any disclaimer, the term of this patent is extended or adjusted under 35 U.S.C. 154(b) by 0 days.

(21) Appl. No.: 09/321,212

(22) Filed: May 27, 1999

(30) Foreign Application Priority Data

May 27, 1998 (KR) ..... 98-19121
Oct. 23, 1998 (KR) ..... 98-44425

(51) Int. Cl.[7] ..... H01P 1/20; H01P 7/10; H01P 7/04

(52) U.S. Cl. ..... 333/202; 333/206; 333/219.1; 333/222

(58) Field of Search ..... 333/202, 206, 333/222, 219.1

(56) References Cited

U.S. PATENT DOCUMENTS 5,608,363 * 3/1997 Cameron et al. ..... 333/202
5,739,733 * 4/1998 Cameron ..... 333/202
5,949,309 * 9/1999 Correa ..... 333/202
5,969,584 * 10/1999 Huang et al. ..... 333/219.1
6,002,311 * 12/1999 Wey et al. ..... 333/219.1

* cited by examiner

*Primary Examiner*—Robert Pascal
*Assistant Examiner*—Patricia T. Nguyen
(74) *Attorney, Agent, or Firm*—Lowe Hauptman Gilman & Berner, LLP

(57) ABSTRACT

The bandpass filter according to the present invention includes a housing having a plurality of cavities, wherein said plurality of cavities are isolated from each other by partitions and wherein each said partition have a coupling window; input/output connectors formed at both ends of said housing so as to pass output signals from a transmitter; coupling loops connected to said input/output connectors so as to excite an applied signal power and to combine resonance modes; dielectric resonators installed in said cavities of said housing so as to resonate a signal power transmitted from said coupling loop to the desired frequency band, said dielectric resonators including: a first resonator group formed in both said cavities which are adjacent to said coupling loops; and a second resonator group formed in said cavities which are positioned between both said cavities which are adjacent to said coupling loops, wherein said resonators of said second resonator group are stepped resonators; a plurality of frequency controllers corresponding to said dielectric resonators, being disposed on a top of said dielectric resonators and being apart from said dielectric resonators by a predetermined distance, whereby the second resonator group removes a needless wave characteristic generated by resonance of the higher-order mode, by moving a higher-order mode characteristic from the first resonator group to a higher frequency band than a fundamental mode frequency.

8 Claims, 14 Drawing Sheets

BANDPASS FILTER WITH DIELECTRIC RESONATORS

BACKGROUND OF THE INVENTION

1. Field of the Invention

The present invention relates to a bandpass filter using dielectric resonator which is used to a mobile radio communication base station such as a cellular mobile telephone, a personal communications service (PCS) and a wireless local loop (WLL), more particularly to a bandpass filter which is transmitting to a few loss signals which lie in a desired frequency band while intercepting all the frequencies outside the desired frequency band by forming the stepped dielectric resonators, and a bandpass filter having a variable notch cable outside the filter to show a desirable attenuation characteristic.

2. Description of the Related Art

Generally, a bandpass filter is the parts used at the mobile radio communication base station such as a cellular mobile telephone, a personal communications service (PCS) and a wireless local loop (WLL), and a radio frequency (RF) band. The role which a bandpass filter is to fulfill is transmitting to a few loss signals which lie in a desired frequency band while intercepting all the frequencies outside the desired band.

A conventional bandpass filter described above has been used to radio-based communications systems operating in the microwave range. FIG. 1B is a perspective view showing a conventional bandpass filter, FIG. 1C is a top view of FIG. 1B.

As shown in FIG. 1B and FIG. 1D, a bandpass filter comprises a metallic housing 12 formed by a plurality of cavities, a dielectric resonator 11 installed in the cavities each of the housing 12, an input/output connector 13 installed on the both side end of the housing 12, a coupling loop 15 combined with the input/output connector 13, a partition 14, which has windows 14*a* for combining resonance mode forms a boundary among cavities, frequency control plate 16, and tuning bar 17.

FIG. 1A is a perspective view showing a dielectric resonator using a bandpass filter.

As shown in FIG. 1A, a uniform dielectric resonator 11 is formed to a cylinder shape. The filter using uniform dielectric resonators involves the needless signals by resonating not only the fundamental mode ($TE_{01\delta}$) but also the higher-order mode. Accordingly, the filter having uniform dielectric resonators has a bad effect on a communications system by needless signals, which is resulted from the higher-order mode, in the neighborhood of the fundamental mode by the higher-order mode.

Also, it is extremely necessary to have a bandpass filter showing high quality coefficient (Q) in the low band region and low insertion loss in the pass band region. In most of the cases, the attenuation characteristic of the specified region to decrease interference between the neighboring channels and the transmitter/receiver bands and must be excellent.

In this case, a conventional method is to use the dielectric resonator having the high quality coefficient. However, this method is not only difficult to accomplish, but also involves a high manufacturing cost. To improve the attenuation characteristic, a conventional bandpass filter has been proposed to install a notch cable in the housing.

FIG. 2A is a perspective view showing a bandpass filter using conventional dielectric resonators. FIG. 2B is a top view of FIG. 2A.

As shown in FIGS. 2A and 2B, when RF signal is applied, the propagation is induced by the first dielectric resonator 21' through a coupling loop 25. The signal power through the window 24*a* of a partition which is controlling a coupling capacity of the signal power and a band width is transmitted to the second dielectric resonator 21". By the same method, Signals of the desired frequency band are transmitted to the output connector 23'. At this time, the higher attenuation is generated in the specified band region by a notch cable 26 inserted into the housing 22. Symbol 27 is a housing cover.

However, above described method decreases a quality coefficient (Q) and increases a loss, because the notch cable changes the inside structure of the filter. Also, transformation and reestablishment after manufacturing of the filter is impossible. The needless wave may arise at certain frequency because of generating another resonance mode by the inserted notch cable 26, also the wave may be distorted by changing the electromagnetic shape in course of resonance.

SUMMARY OF THE INVENTION

It is an object of the present invention to provide an improved bandpass filter using dielectric resonators, which suppress a needless wave generation of near the fundamental mode by forming the stepped dielectric resonators.

It is another object of the present invention to provide a dielectric resonator bandpass filter, which improves the attenuation characteristic with changing inside structure by installing a variable notch cable.

In accordance with an aspect of the present invention, there is provided a bandpass filter using dielectric resonator comprising: a housing having a plurality of cavities, wherein said plurality of cavities are isolated from each other by partitions and wherein each said partition have a coupling window; input/output connectors formed at both ends of said housing so as to pass output signals from a transmitter; coupling loops connected to said input/output connectors so as to excite an applied signal power and to combine resonance modes; dielectric resonators installed in said cavities of said housing so as to resonate a signal power transmitted from said coupling loop to the desired frequency band, said dielectric resonators including: a) a first resonator group formed in both said cavities which are adjacent to said coupling loops; and b) a second resonator group formed in said cavities which are positioned between both said cavities which are adjacent to said coupling loops, wherein said resonators of said second resonator group are stepped resonators; a plurality of frequency control means corresponding to said dielectric resonators, being disposed on a top of said dielectric resonators and being apart from said dielectric resonators by a predetermined distance, whereby the second resonator group removes a needless wave characteristic generated by resonance of the higher-order mode, by moving a higher-order mode characteristic from the first resonator group to a higher frequency band than a fundamental mode frequency.

BRIEF DESCRIPTION OF THE DRAWINGS

These and other objects, and features and advantages of the invention, as well as the invention itself, will become better understood by reference to the following detailed description of the presently preferred embodiments when considered in conjunction with the accompanying drawings, in which.

DETAILED DESCRIPTION OF THE PREFERRED EMBODIMENTS

Embodiments of the present invention will be explained with reference to the drawings.

Figure 1A:
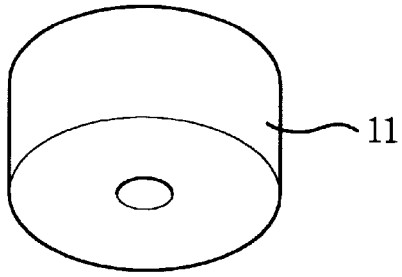
FIG. 1A (PRIOR ART)
FIG. 1A is a perspective view of a uniform dielectric resonator according to a prior art.
Figure 1B:
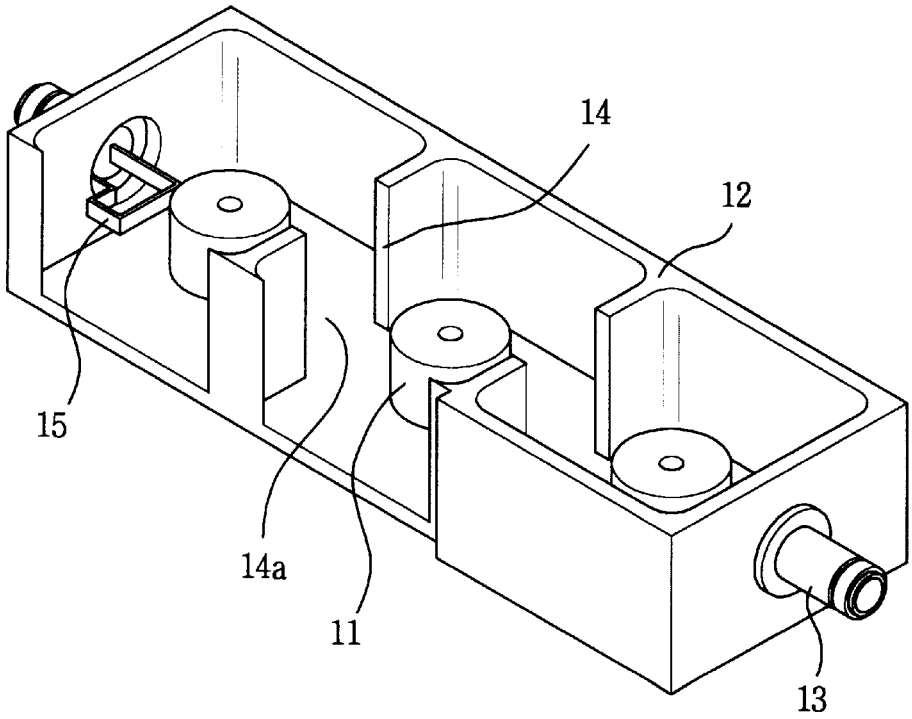
FIG. 1B (PRIOR ART)
FIG. 1B is a perspective view of a bandpass filter using uniform dielectric resonators according to a prior art.
Figure 1C:
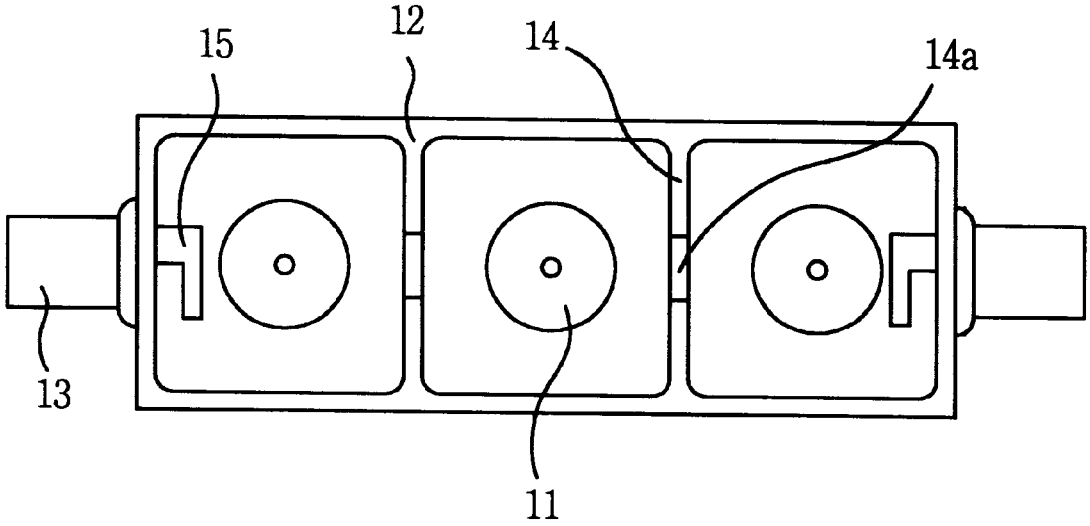
FIG. 1C (PRIOR ART)
FIG. 1C is a top view of FIG. 1B.
Figure 1D:
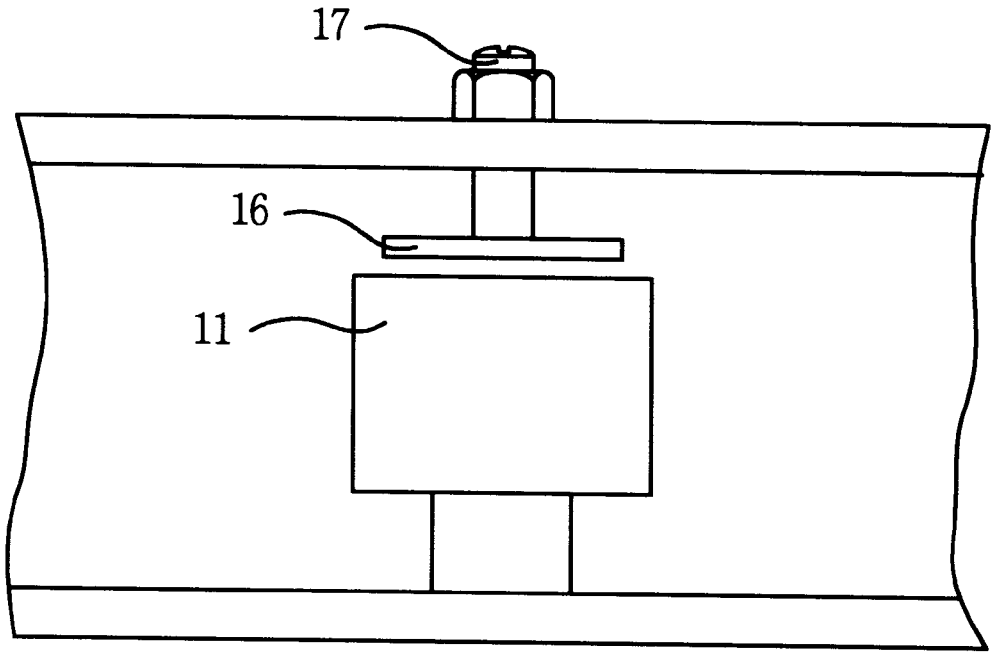
FIG. 1D (PRIOR ART)
FIG. 1D is a cross sectional view of FIG. 1C.
Figure 2A:
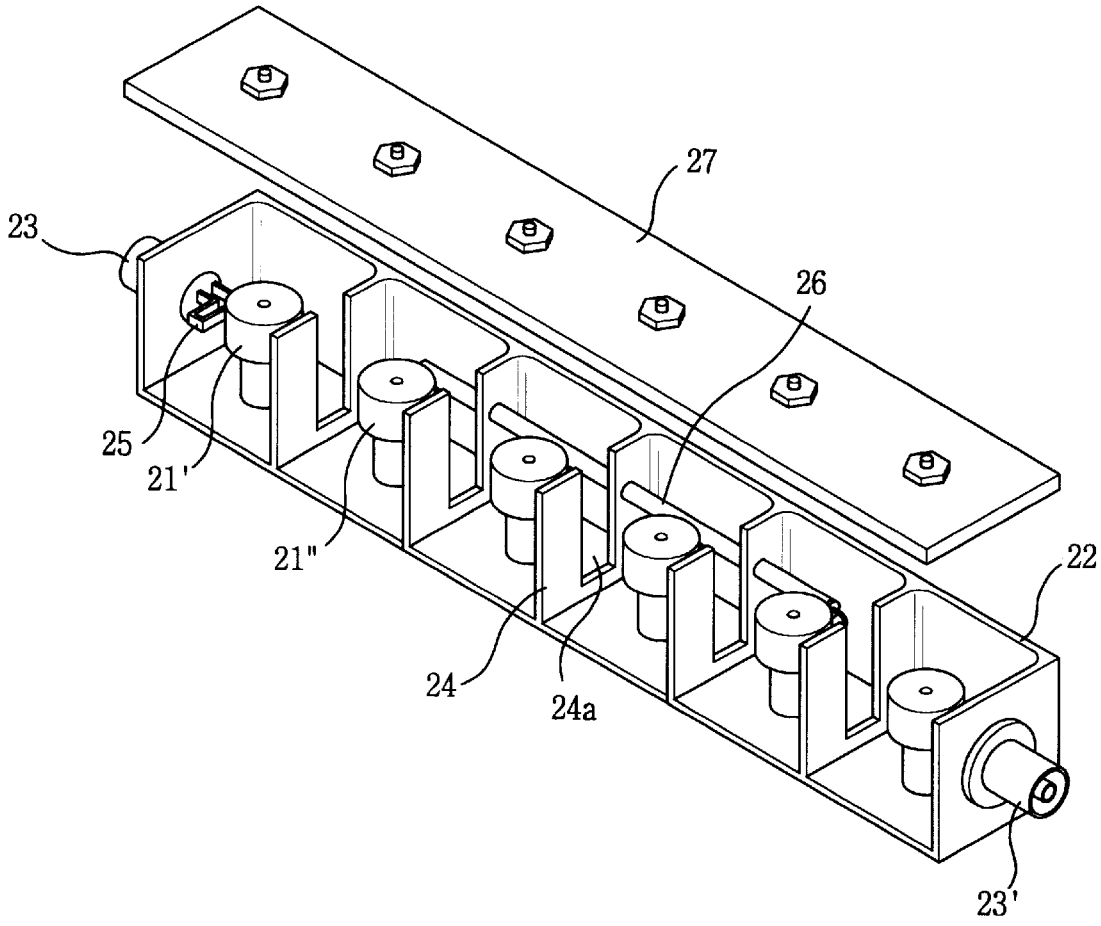
FIG. 2A (PRIOR ART)
FIG. 2A is a perspective view of a bandpass filter using dielectric resonators installed with a notch cable according to a prior art.
Figure 2B:
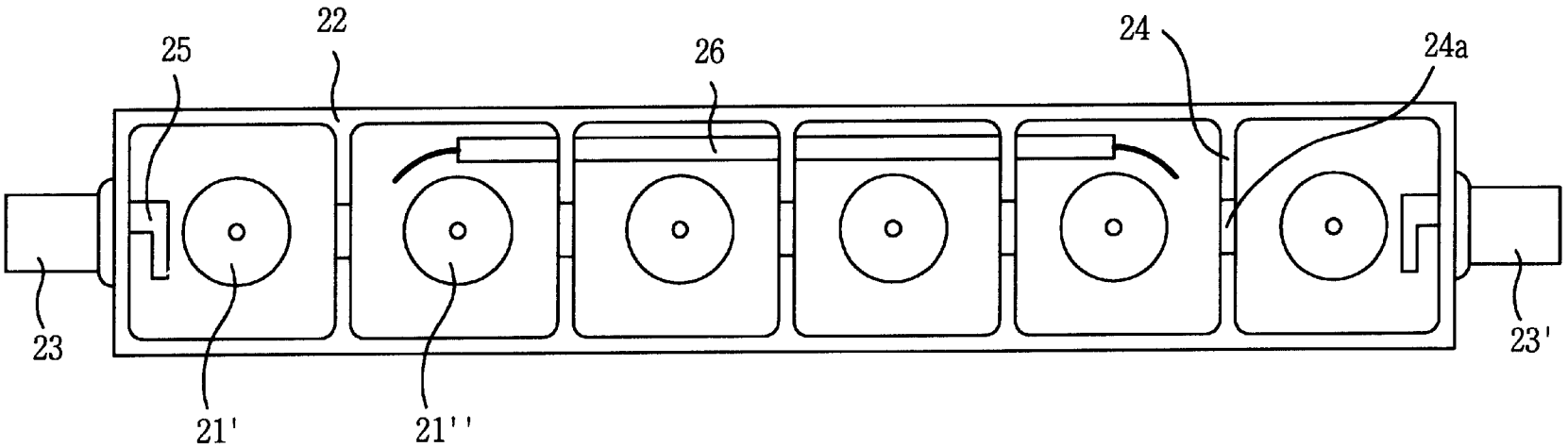
FIG. 2B (PRIOR ART)
FIG. 2B is a top view of FIG. 2A.
Figure 3:
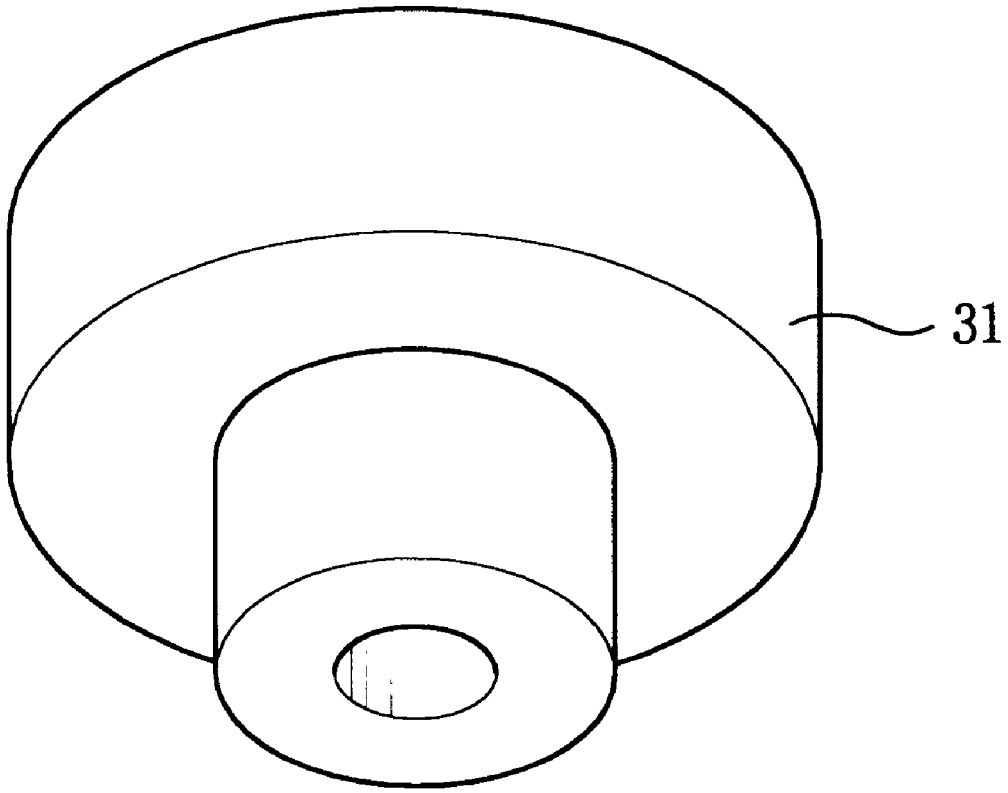
FIG. 3 is a perspective view of a stepped dielectric resonator used in the bandpass filter according to the present invention.

FIG. 3 is a perspective view of a stepped dielectric resonator used in the bandpass filter.

As shown in FIG. 3, a diameter of the upside of a stepped dielectric resonator 31 is larger than that of the downside.

Figure 4A:
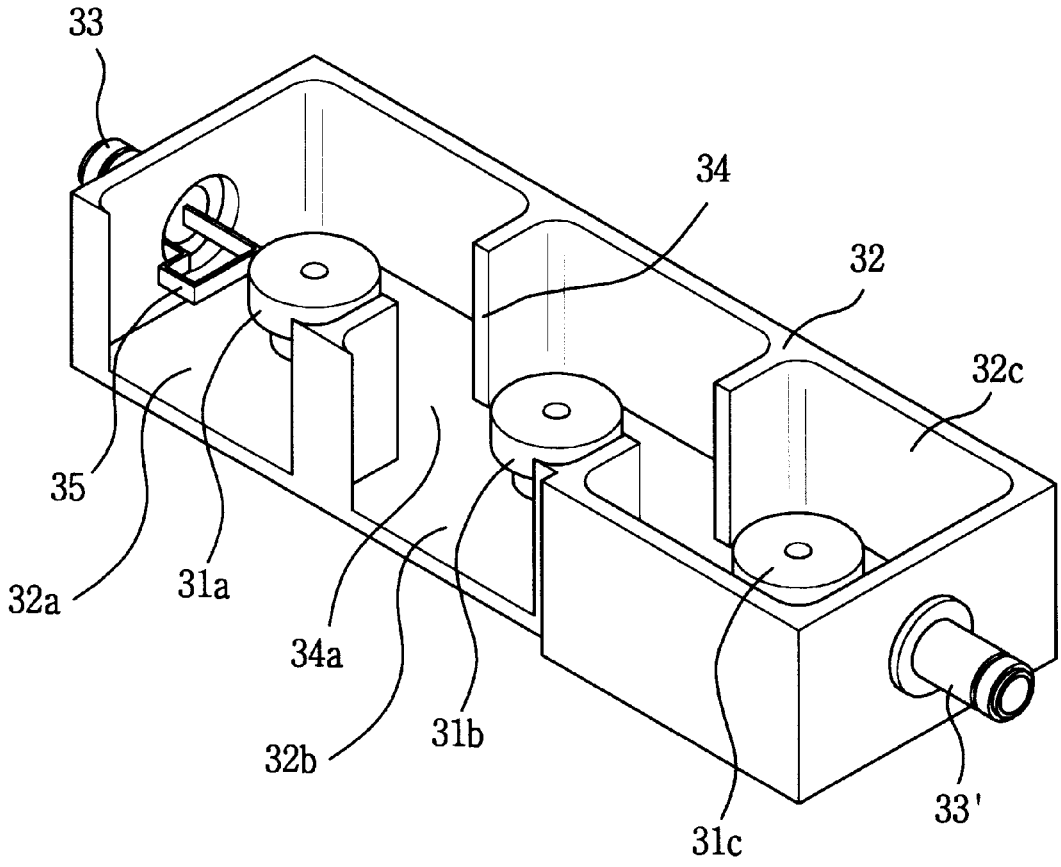
FIG. 4A is a perspective view of a bandpass filter using stepped dielectric resonators according to the present invention.
Figure 4B:
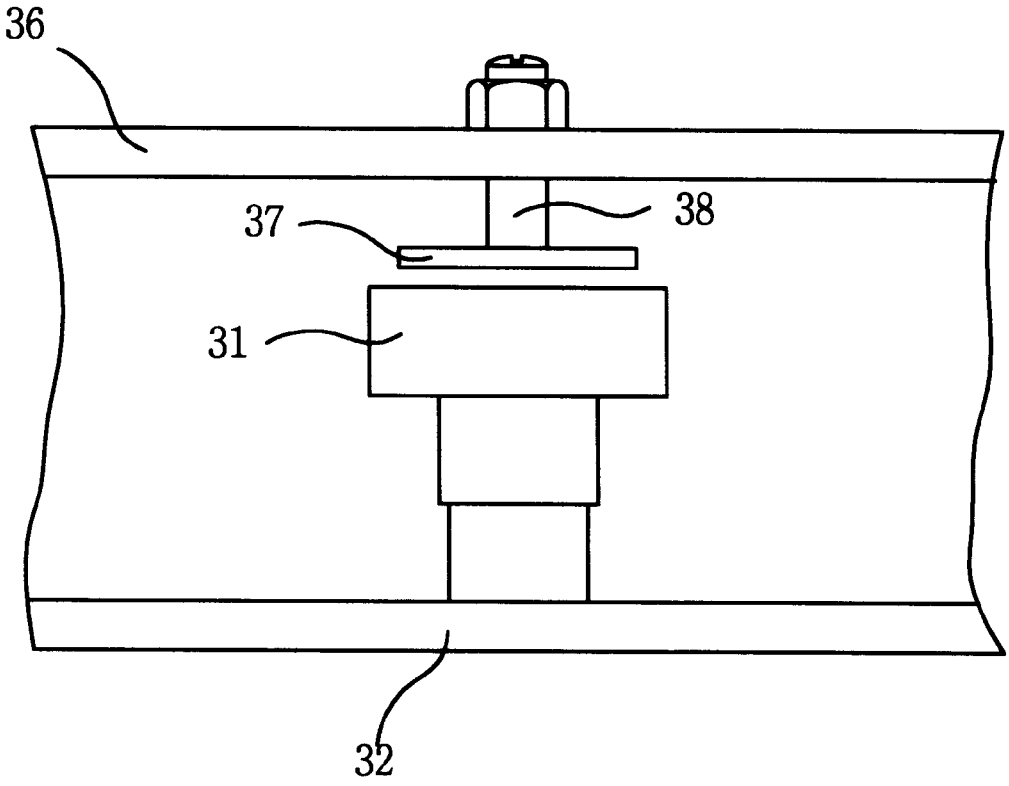
FIG. 4B is a cross-sectional view of FIG. 4A.

FIGS. 4A and 4*b* are perspective and cross-sectional views of a bandpass filter using stepped dielectric resonators according to a first aspect of the present invention.

As shown in FIGS. 4*a* and 4*b*, a housing 32 of an regular hexahedral configuration is formed to a plurality of cavities 32*a*, 32*b* and 32*c* which are arranged in a array within its inside. A cover 36 covers the top of the housing. A plurality of stepped dielectric resonators 31*a*, 31*b*, and 31*c* are introduced into the cavities 32*a*, 32*b*, and 32*c*, respectively. The boundary of the cavities 32*a*, 32*b*, and 32*c* is divided by the partition 34. A coupling window 34*a* combines a resonance mode among the dielectric resonators 31*a*, 31*b*, and 31*c*. An input/output connector 33 passes the signals outputted at the transmitter by installing on both ends of the housing 32. A coupling loop 35 excites and transmits an applied signal power to stepped dielectric resonators 31*a*, 31*b*, and 31*c*. Control plate 37 and tuning bar 38 which control minutely a resonance frequency are positioned separately from the fixed interval on the top of the stepped dielectric resonators 31*a*, 31*b*, and 31*c*.

Accordingly, when a radio signal is applied to input connector 33, the electromagnetic waves are induced between the coupling loop 35 and the stepped dielectric resonator 31*a*. When a fundamental mode ($TE_{01\delta}$) which resonates through the stepped dielectric resonator 31*a* and a higher-order mode are transmitted to the stepped dielectric resonator 31*b*, the needless wave characteristic generated by resonance of the higher-order mode is moved to the higher frequency than the fundamental mode frequency.

The signals of the desired frequency band are transmitted to the output connector 37 through the coupling window 34*a* between the stepped dielectric resonator 31*a* and the stepped dielectric resonator 31*b*. Also, the filter characteristic is maximized by controlling minutely the interval between the dielectric resonator 31 which is fixed in the housing by using the tuning bar 38 and the frequency control plate 37.

Figure 5:
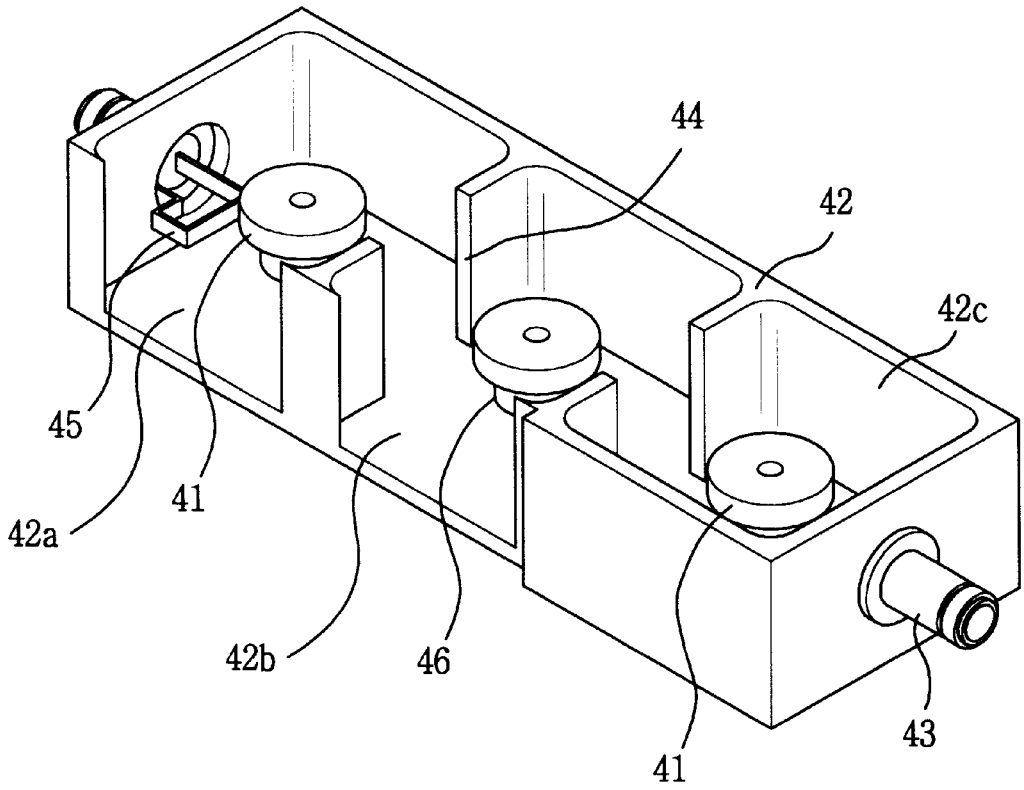
FIG. 5 is a perspective view of a bandpass filter using stepped and uniform dielectric-resonators according to the present invention.

FIG. 5 is a perspective view of a bandpass filter using stepped and uniform dielectric-resonators according to a second aspect of the present invention.

As shown in FIG. 5, a bandpass filter comprises a coupling loop 45 into the first cavity 42*a*, a stepped dielectric resonator 46 into the second cavity 42*b*, and a uniform dielectric resonator 41 into the third cavity 42*c*.

Figure 6:
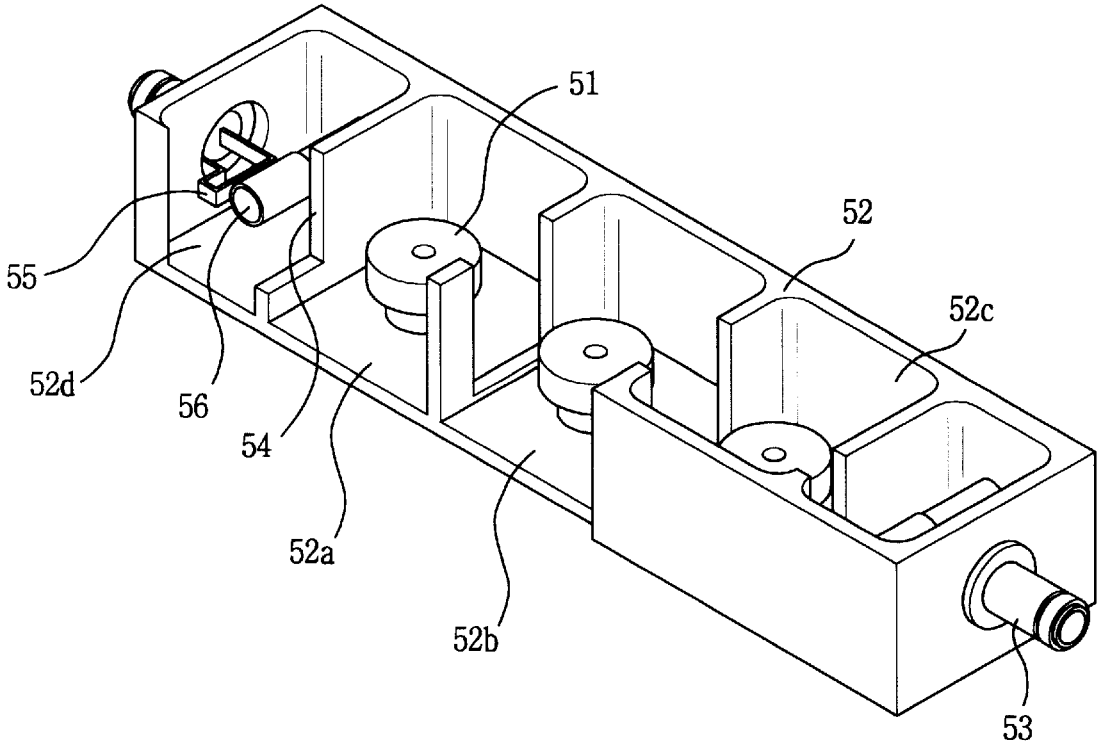
FIG. 6 is a perspective view of a bandpass filter using stepped dielectric resonators and stepped coaxial resonators according to the present invention.

FIG. 6 is a perspective view of a bandpass filter using stepped dielectric resonator and coaxial resonators according to a third aspect of the present invention.

As shown in FIG. 6, a bandpass filter comprises a stepped coaxial resonator 56 into the fourth cavity 52*d* being the coupling loop 55 and a stepped dielectric resonator 51 into the cavities 52*a*, 52*b* and 52*c*.

As described above, in the case of transmission of the radio signals, the each dielectric resonator are transmitted signals through the coupling loop. The higher-order modes, which are generated from the each dielectric resonator, are generated to the higher frequency so that the higher-order mode resonance at the fundamental mode is suppressed by the stepped dielectric resonator. That is, the resonance of the higher-order mode is largely suppressed by forming resonators except those adjacent to coupling loops at input and output of the filter to the stepped dielectric resonator.

Accordingly, the bandpass filters using the stepped dielectric resonator, the stepped and uniform dielectric resonators, and the stepped and stepped coaxial dielectric-resonators can provide a radio wave of good quality to the mobile radio communication of the microwave range such as cellular, PCS, WLL, and IMT-2000.

Figure 7A:
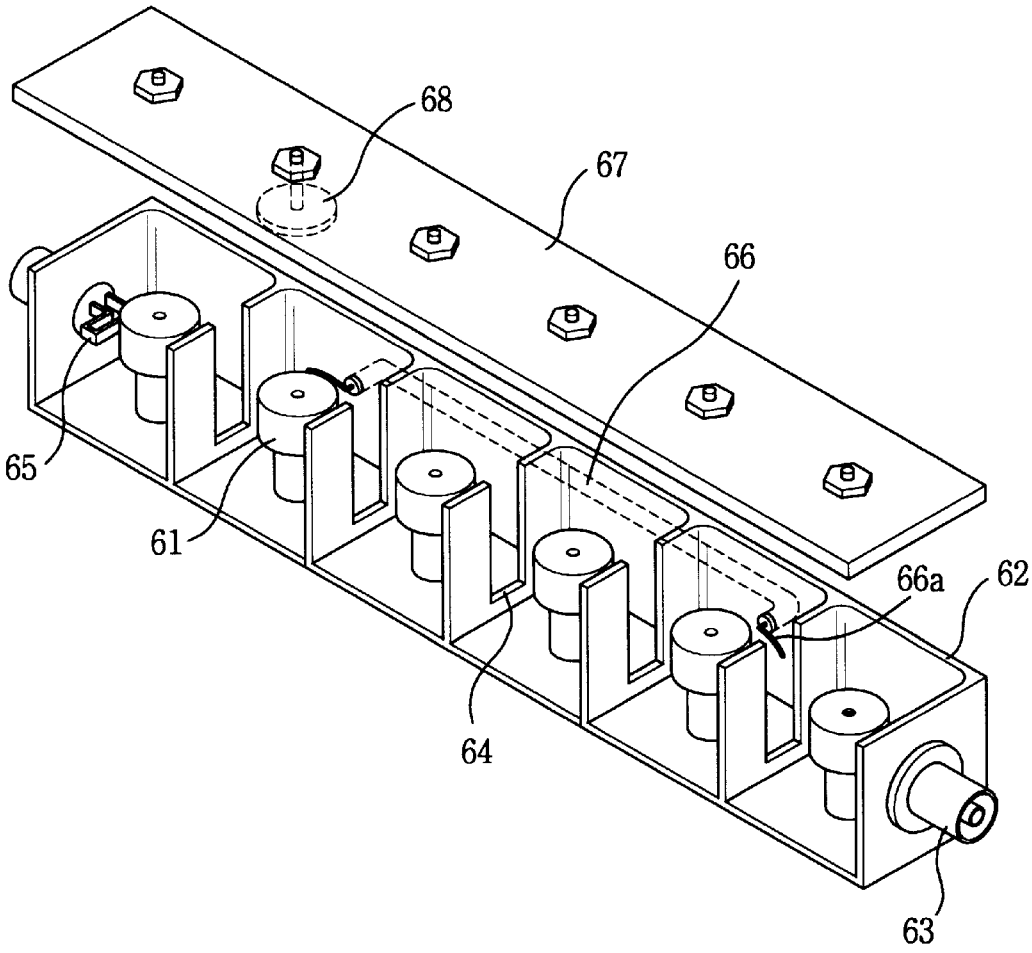
FIG. 7A is a perspective view of a bandpass filter using stepped dielectric resonators installed with a variable notch cable according to the present invention.
Figure 7B:
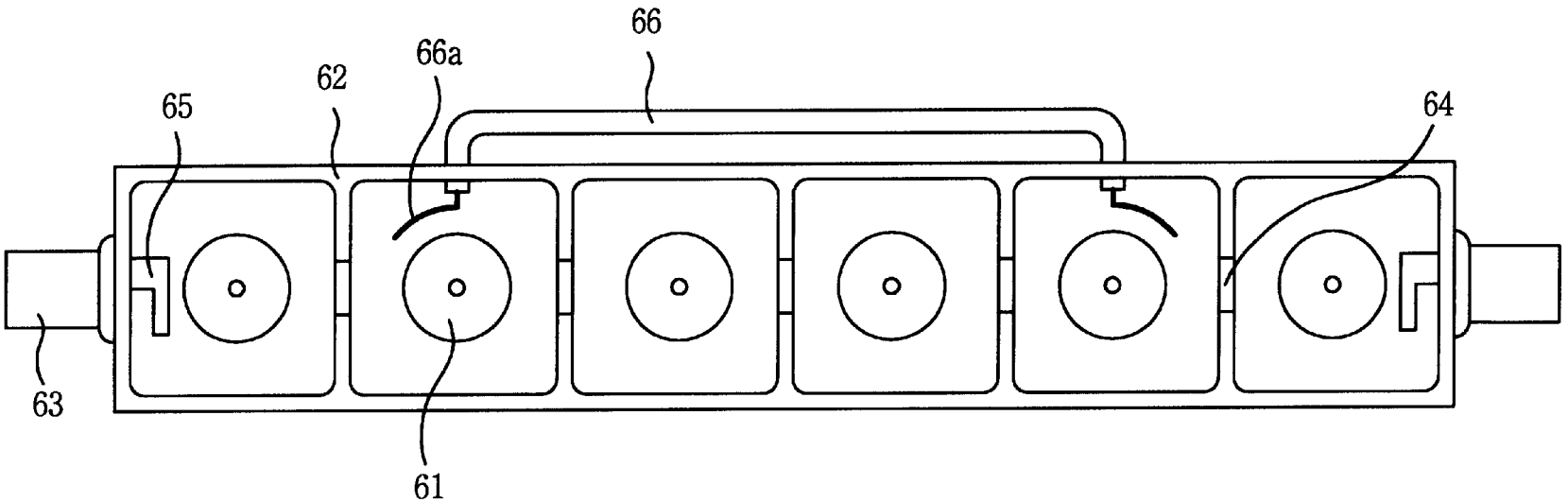
FIG. 7B is a top view of FIG. 7A.

FIG. 7A is a perspective view of a bandpass filter using stepped dielectric resonators installed with a variable notch cable according to a fourth aspect of the present invention, and FIG. 7B is a top view of FIG. 7A.

As shown in FIGS. 7A and 7B, a notch cable 66 is connected after a penetration to the inside from the outside of the housing 62. A center wire of the notch cable 66*a* is nearly positioned on the dielectric resonator 61.

Figure 8A:
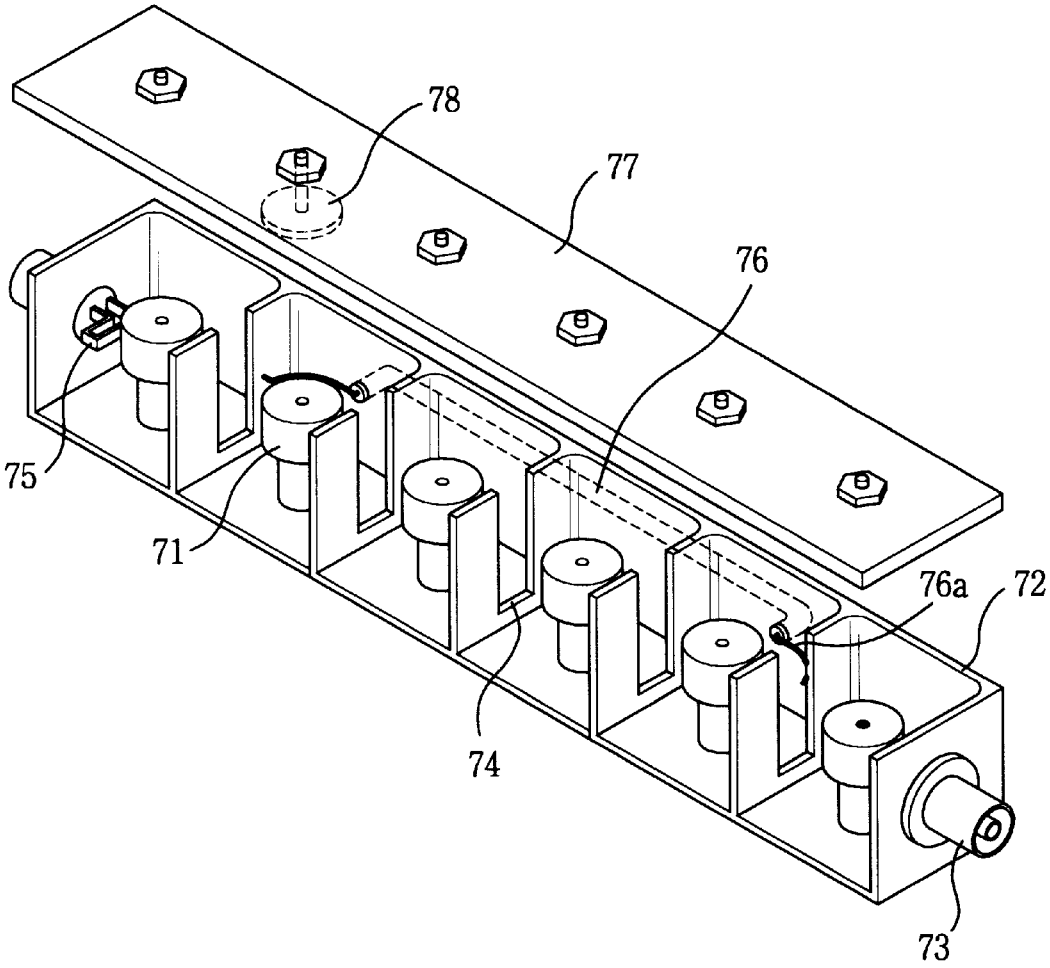
FIG. 8A is a perspective view of a bandpass filter using stepped dielectric resonators installed with a variable notch cable according to the present invention.
Figure 8B:
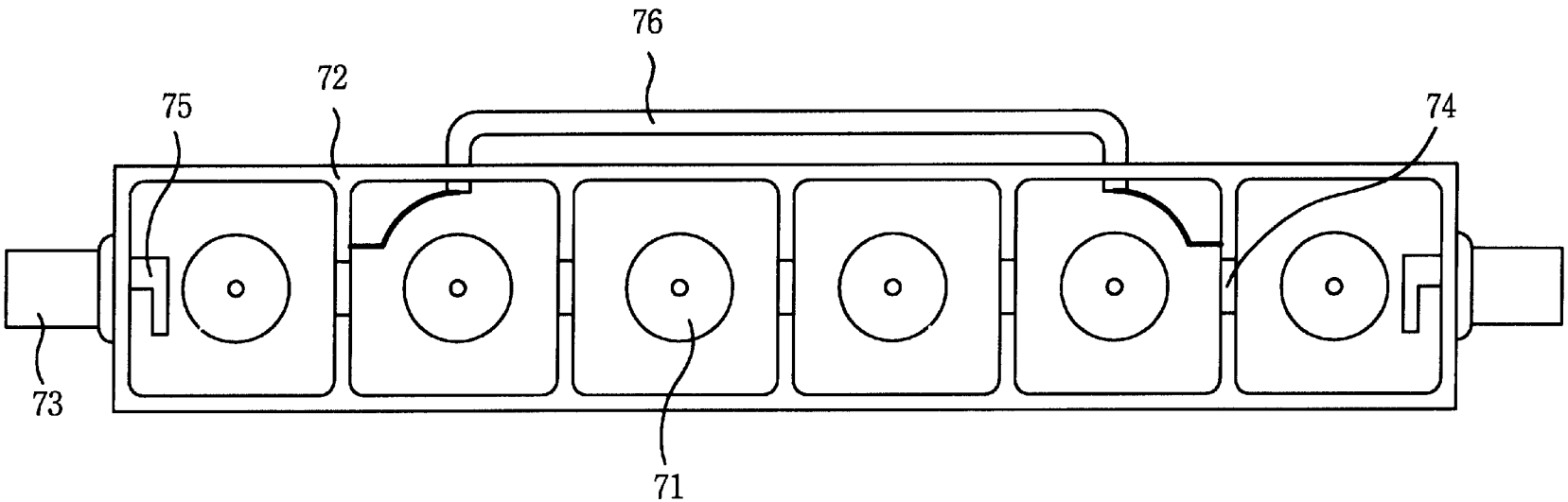
FIG. 8B is a top view of FIG. 8A.

FIG. 8A is a perspective view of a bandpass filter using stepped dielectric resonators installed with a variable notch cable according to a fifth aspect of the present invention, and FIG. 8B is a top view of FIG. 8A.

As shown in FIGS. 8A and 8B, a notch cable 76 is connected after penetrating to the inside from the outside of the housing 72. A center wire of the notch cable 76*a* is positioned on the wall of the partition. Accordingly, an advantage of the invention is possible a minute control of the center wire.

The function of the notch cables 66 and 76 according to fourth and fifth aspects of the present invention will be explained hereinafter.

First, the minute current is induced by a center wire of the notch cables 66 and 76 by the electric and magnetic components which is resonated at the second dielectric resonators 61' and 71', and transmitted to fifth resonators 61" and 71" by another center wire. Such current component affects a main signal power transmitted at each dielectric resonator form the input connectors 63 and 73 by generating the electric and magnetic components at the fifth resonators 61" and 71" again. Similarly, the current induced to a center wire adjacent at the fifth resonators 61" and 71" affects to a signal power of the second dielectric resonators 61' and 71'.

As described above, The big attenuation occurs except for the desired specified band by controlling the center wire length of notch cables 66 and 76, and the distance between the center wire and the dielectric resonator. That is, the more the center wire nears at the dielectric resonator, the more the attention occurs at the near region from the pass band. On the other hand, the more the center wire distances at the dielectric resonator, the more the attention occurs at the distant region from the pass band.

Advantage according to fourth and fifth aspects of the invention is that the attention effect is definitely superior so that the notch cable is not nearly affects to the inside structure of the filter. The needless waves or the distortion of the wave are not occurred, because the resonance mode is not nearly affected. Also, the reinstallation of a variable notch cable is quite easier than built-in type.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A bandpass filter using dielectric resonator, comprising:

a housing having a plurality of cavities, wherein said plurality of cavities are isolated from each other by partitions and wherein each said partition have a coupling window;

input/output connectors formed at both ends of said housing so as to pass output signals from a transmitter;

coupling loops connected to said input/output connectors so as to excite an applied signal power and to combine resonance modes;

dielectric resonators installed in said cavities of said housing so as to resonate a signal power transmitted from said coupling loop to the desired frequency band, said dielectric resonators including:

a first resonator group formed in both said cavities which are adjacent to said coupling loops; and a second resonator group formed in said cavities which are positioned between both said cavities which are adjacent to said coupling loops, wherein said resonators of said second resonator group are stepped resonators;

a plurality of frequency control means corresponding to said dielectric resonators, being disposed on a top of said dielectric resonators and being apart from said dielectric resonators by a predetermined distance, whereby the second resonator group removes a needless wave characteristic generated by resonance of the higher-order mode, by moving a higher-order mode characteristic from the first resonator group to a higher frequency band than a fundamental mode frequency.

2. A bandpass filter using dielectric resonator, comprising:

a housing having a plurality of cavities, wherein said plurality of cavities are isolated from each other by partitions and wherein each said partition have a coupling window;

input/output connectors found at both end of said housing so as to pass output signals from a transmitter;

coupling loops connected to said input/output connectors so as to excite an applied signal power and to combine resonance modes;

dielectric resonators installed in said cavities of said housing so as to resonate a signal power transmitted from said coupling loop to the desired frequency band, said dielectric resonator including:

a first resonator group formed in both said cavities which are adjacent to said coupling loops, wherein said dielectric resonators of the first resonator group is a uniform dielectric resonator; and a second resonator group formed in said cavities which are positioned between both said cavities which are adjacent to said coupling loop, wherein said resonators of said second resonator group are stepped resonators;

a plurality of frequency control means corresponding to said dielectric resonators, being disposed on a top of said dielectric resonators and being apart from said dielectric resonators by a predetermined distance, whereby the second resonator group removes a needless wave characteristic generated by resonance of the higher-order mode, by moving a higher-order mode characteristic from the first resonator group to a higher frequency band than a fundamental mode frequency.

3. A bandpass filter using dielectric resonator as defined in claim 1, wherein the stepped resonators are formed by stepped coaxial cables.

4. A bandpass filter using dielectric resonator as defined in claim 1, wherein the dielectric resonators of said the first resonator group are stepped resonators.

5. A bandpass filter using dielectric resonator comprising:

a housing having a plurality of cavities, wherein said plurality of cavities are isolated from each other by partitions and wherein each said partition have a coupling window;

input/output connectors formed at both end of said housing so as to pass output signals from a transmitter;

coupling loops connected to said input/output connectors so as to excite an applied signal power and to combine resonance modes;

dielectric resonators installed in said cavities of said housing so as to resonate a signal power transmitted from said coupling loop to the desired frequency band, said dielectric resonator including:

a first resonator group formed in both said cavities which are adjacent to said coupling loops; and a second resonator group formed in said cavities which are positioned between both said cavities which are adjacent to said coupling loop, wherein said resonators of said second resonator group are stepped resonators;

a plurality of frequency control means corresponding to said dielectric resonators, being disposed on a top of said dielectric resonators and being apart from said dielectric resonators by a predetermined distance; and a notch cable which goes through said partitions and comprises center wires extending to the resonators so as to control attenuation characteristics, whereby the second resonator group removes a needless wave characteristic generated by resonance of the higher-order mode, by moving a higher-order mode characteristic from the first resonator group to a higher frequency band than a fundamental mode frequency.

6. A bandpass filter using dielectric resonator as defined in claim 5, wherein said notch cable has a variable length.

7. A bandpass filter using dielectric resonator as defined in claim 5, wherein said center wires is apart from said dielectric resonators by a predetermined distance.

8. A bandpass filter using dielectric resonator as defined in claim 5, wherein said center wire of said notch cable is in contact with walls of said partitions.

* * * * *